US005454508A

United States Patent [19]

Billen

[11] Patent Number: 5,454,508

[45] Date of Patent: Oct. 3, 1995

[54] ONE PIECE VEHICLE REPLICA CONTAINER

[76] Inventor: William D. Billen, 1225 SW. Mulvane, Topeka, Kans. 66604

[21] Appl. No.: 209,444

[22] Filed: Mar. 10, 1994

[51] Int. Cl.[6] ..... B65D 5/02

[52] U.S. Cl. ..... 229/116.4; 446/80; 446/488

[58] Field of Search ..... 206/457; 446/76, 446/80, 230, 448; 229/8, 162; D9/308, 433; D21/76, 78, 136

[56] References Cited

U.S. PATENT DOCUMENTS

| | | | |
|---|---|---|---|
| D. 201,462 | 6/1965 | Klein | D9/308 X |
| D. 214,262 | 5/1969 | Paige | D9/308 |
| 2,635,506 | 4/1953 | Chaimson | 229/8 X |
| 4,055,250 | 10/1977 | Mayhew | 206/457 |
| 4,643,349 | 2/1987 | Sheffer | 206/457 X |
| 4,713,012 | 12/1987 | Poplawski et al. | 446/488 X |
| 4,804,133 | 2/1989 | Kiyokane | 229/8 |
| 4,807,802 | 2/1989 | Williams | 229/8 X |
| 4,830,270 | 5/1989 | Holmes | 229/150 X |

*Primary Examiner*—Stephen J. Castellano
*Assistant Examiner*—Christopher J. McDonald
*Attorney, Agent, or Firm*—Bruce J. Clark

[57] ABSTRACT

The invention is a one-piece planer foldable cardboard-like vehicle having artwork thereon and capable of being easily assembled into a vehicle replica, said planer material having four segments, one of which has a bottom segment with two opposing ends, and extending from each end a trunk section having transverse fold lines and having connecting means, and from the other end a hood segment, which in another variation has transverse fold lines and tabs, defining a windshield assembly, such that when the hood segment is brought forward over the front end of the top segment and between two wheel wells in the top segment, which wheel wells are formed by opposing cuts and longitudinal fold lines within the top segment; and connected to the front end of the top segment, the front of the vehicle is formed. The top segment also has an interior opening with a downward folding portion providing for a dashboard and steering wheel.

12 Claims, 3 Drawing Sheets

ONE PIECE VEHICLE REPLICA CONTAINER

BACKGROUND OF INVENTION

The present invention relates to the field of cardboard model vehicle, more specifically, vehicle replica containers made from cardboard material or the like.

Model cars made from cardboard or other semi-rigid material have been around for years. These cars have been made from one or more pieces of cardboard like material, sometimes from cut outs and sometimes from one single sheet of cardboard like material. When intended as a promotional device, it is desired and necessary that the cardboard model be easily and quickly constructed and thus it is often required that the model be constructed from one cardboard sheet. Advantages of a one sheet, i.e., one-piece unit, include factors such as lower cost, easier printing of the model design or artwork on the cardboard, compact shipping, and ease and quickness in construction, are advantages of a one-piece system; however, the one-piece system also makes very difficult the availability to accurately replicate the designated automobiles.

Kiokane, for example, U.S. Pat. No. 4,804,133, discloses a one-piece cardboard vehicle replica. However, the resulting structure does not provide or allow for a realistic representation of such things as the interior of the car, nor does it provide for a realistic steering wheel structure and appearance, dashboard shelf and speedometer structure. Neither does it allow for such things as more accurate representations of fender well structures, recessed head lights, front ends nor the fuller windshields of the older model cars (1950's for example) which often included window wings. A sturdier structure is needed also for it to be used as a coin bank. These are some of the limitations of the prior art.

An entire new structure is thus required to allow for such realistic features. It is thus an object of the invention to provide a one-piece cardboard-like structure cut in such a manner so as to allow it to be folded into a more accurate representation of automobiles, including older automobiles, allowing for more realistic appearing interior structures, front ends and back ends, with fuller windshields providing for window wings and more realistic representations of fender wells and headlights structures. It is also an object to allow for, in one version of the invention, the front hood and/or rear hood to be, or appear to be, lower than the fenders on either side, and bowed.

The instant invention thus allows for a device that is easy to manufacture, has built in structure allowing for the side window (wing windows) in the older automobiles; has a unique cover above the headlights allowing for recessed headlights; it allows for a dashboard shelf and a dashboard control panel allowing for three dimensional or two dimensional type replicas on the dashboard shelf; it allows for a more realistic appearing steering wheel, allows for a stronger bottom and allows for easier shaping of the hood by varying the location of the tab and cut of the hood-windshield assembly and fold lines within the hood assembly.

It is also an object of the invention that the interior of the car be able to carry items and things such as food in take out restaurants, coins, candies, toys, etc.

Other objects and features of the invention and the manner in which the invention achieves its purpose will be appreciated from the following description and the accompanying drawings which exemplify the invention, it being understood that changes may be made in the specific method and apparatus disclosed herein without departing from the essentials of the invention set forth in the appended claims.

BRIEF SUMMARY OF THE INVENTION

A vehicle replica container is disclosed made of a one-piece planer foldable cardboard-like material, which replica also has an interior portion capable of holding wrapped food or other contents. The one-piece planer foldable cardboard-like material has four segments representing a bottom segment of the automobile, two sides, and a top portion having an interior opening; each of the four segments is defined by longitudinal fold lines; at each opposing end of the bottom section is a front end and a rear end. The front end has a hood-windshield assembly section folding over the front end of the top segment to create the front hood and a hood-windshield assembly to form side windows as well as the front windshield section. The interior opening of the top end has a downward folding steering wheel-dashboard portion to create a more realistic appearing dash, steering wheel and windshield assembly. The front end of the top segment also has downward folding longitudinal tabs creating defining wheel wells and replicating headlight arrangements predominant in older model vehicles.

DESCRIPTION OF THE PREFERRED EMBODIMENT

Figure 1:
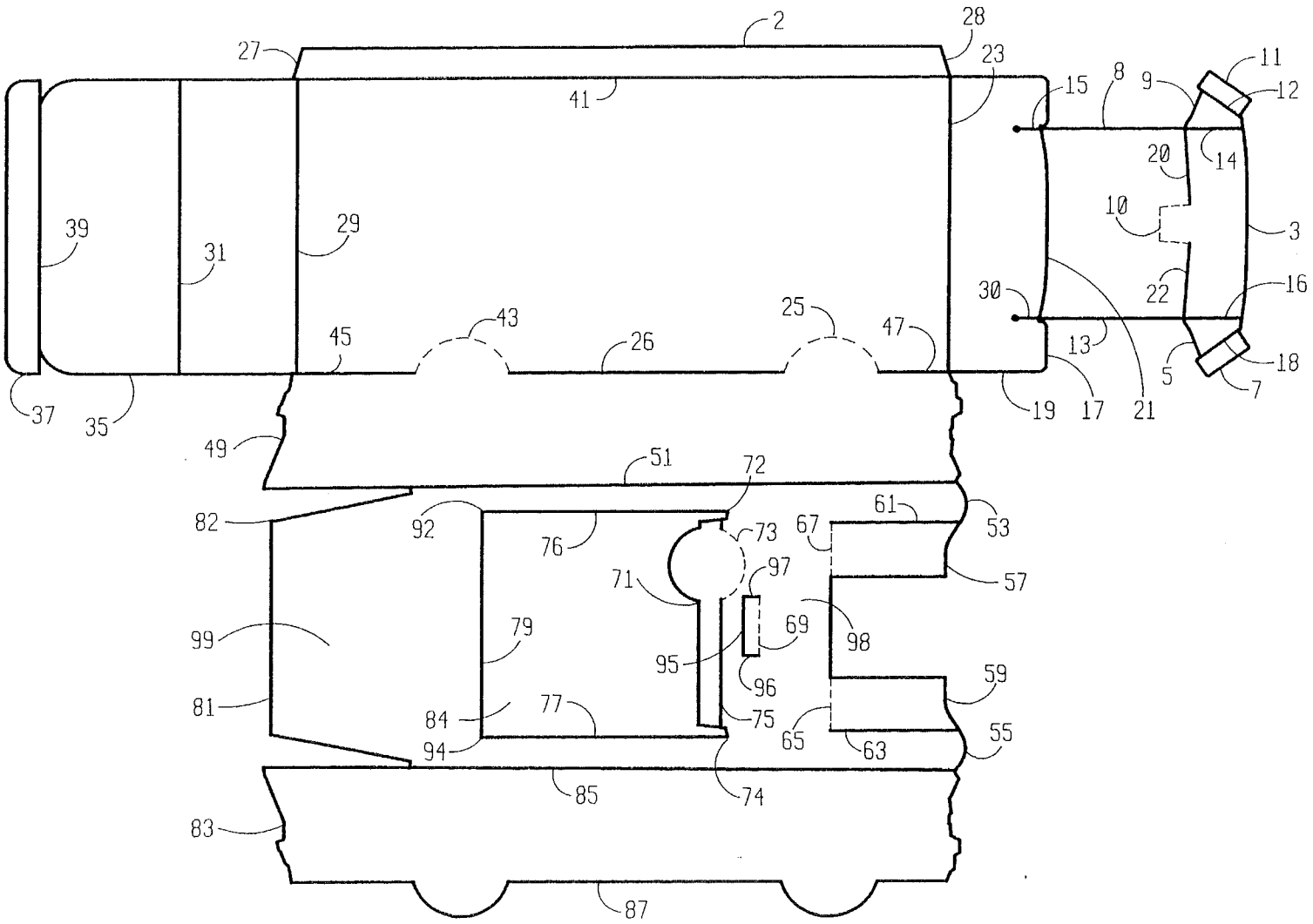
FIG. 1 is the principal view of the invention showing the shape, fold lines and cuts as further described in the specification.
Figure 2:
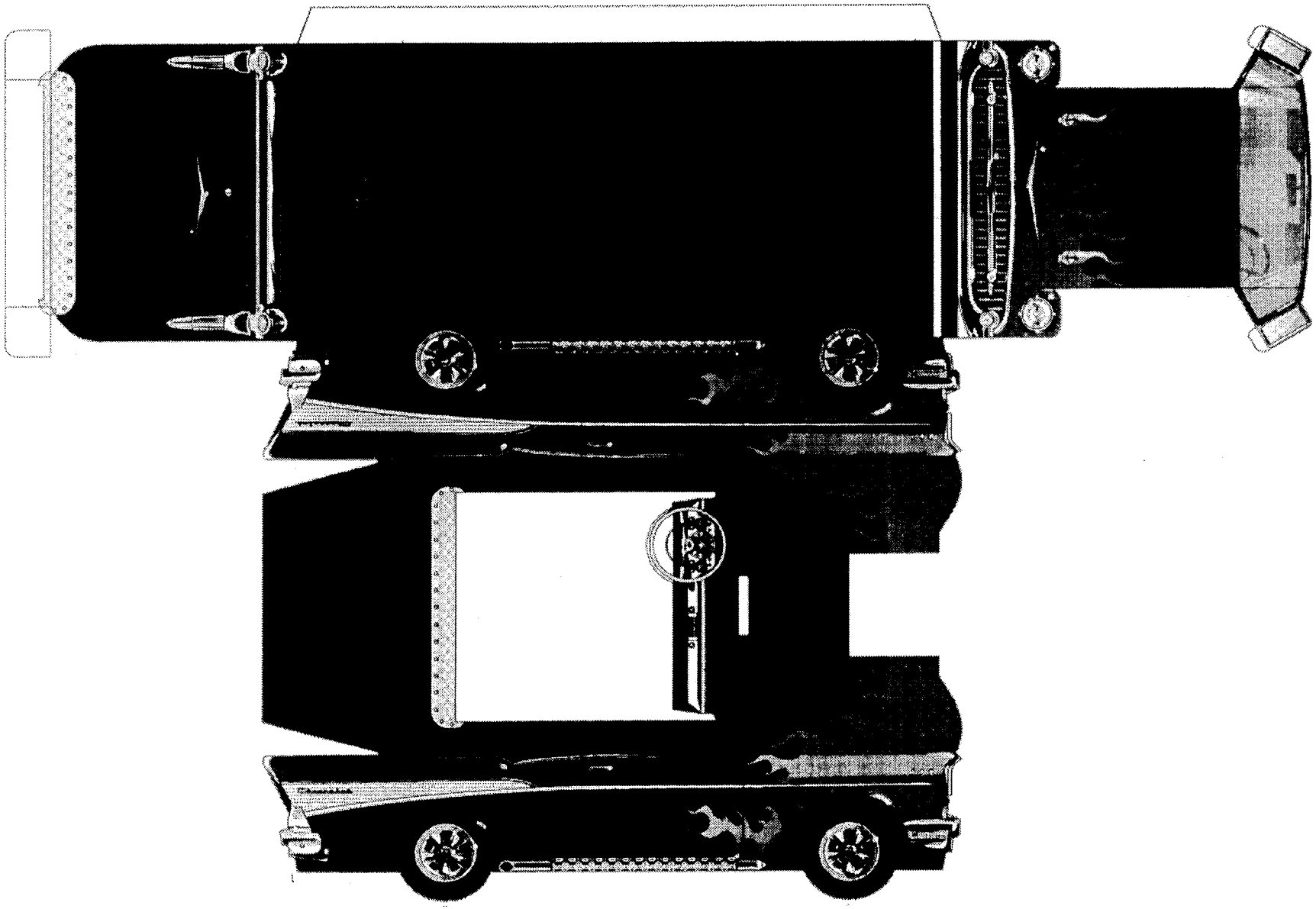
FIG. 2 is the invention shown with a printed automobile thereon.

The invention consists of an automobile replica forming planer sheet of cardboard-like material substantially shown in FIG. 1. It is understood that "cardboard-like" as used herein means cardboard material or the like and refers to any semi-rigid material capable of retaining fold directing lines and capable of being folded and of having slits therein. Slits, partial and/or spaced apart cuts, and perforations, are shown as dotted lines. The planer sheet in FIG. 1 shows the preferred embodiment as having four segments, a bottom segment 27, a left side 49, a top portion 82, and a right side 83, all adjacent to each other in the positions shown. The top portion has a front end 98 and a rear end 99. In the preferred embodiment the planer sheet has two opposing longitudinal sides, 2 and 87, and attached to each other via the connecting tab 28 using adhesive means. However, it should be noted that the sheet can be cut so that the two sides occur anywhere laterally along the sheet. It is significant however that regardless of where the cut defines the two sides, that the four segments are situated substantially parallel to each other in the order shown so as to create, when folded at folds 85, 51, 41, and at 45, 26, 47, that two sides, a top and a bottom are created as shown in FIG. 2 when the two sides are connected. "Substantially parallel" here refers to parallel or near parallel within a ten degree variation.

In FIG. 1, bottom segment 27 is defined from the left side 49 by fold 45, 26 and 47, along which are also wheel cuts 43 and 25. Transverse to said fold lines is the first transverse fold 23, second transverse fold 29 and third transverse fold 39 defining the rear end and trunk. The first transverse fold 23 defines and separates an extending hood-windshield assembly section 8 comprising a front grill 19, a front hood separated therefrom by slightly curved fold 21. Also extending at the opposing end of the assembly 8 is a windshield assembly 3 having windshield wings 5 and 9 at opposing ends of said windshield assembly, wing tabs 7 and 11 extending outwardly therefrom on either end, so that when folded at folds 12, 14, 16, 18, 20 and 22, and at 23 and 21, said tabs will connect at 72 and 74 respectively in the interior portion next to the dashboard ends in the top segment 82. The windshield assembly 3 has folds 20 and 22 between the windshield wings 5 and 9, and centered at the fold line is a hood tab defining cut 10. The tab thus created a cut 10 is situated so as to extend (when the folds 20 and 22 are made) so as to insert in the receiving hole 69 in the top segment 82.

It should be noted that the term "fold lines" is defined herein to mean physical depressions formed in the cardboard, or other structural means equivalent thereto that serve the purpose of easily defining the location of the fold, including scores, spaced apart cuts, perforations, creases, or partial cuts through a portion of the cardboard.

Also in the hood-windshield assembly 8 are located cuts 15 and 30 to define the headlight and front wheel well area often prevalent in older model vehicles.

In this manner, the hood-windshield assembly 8 folds back and the hood portion 13 sits on top of the front portion of top segment 82 situated between folds 61 and 63 and thus provides some difference in height with the top segment 82 so as to make the hood 8 rise somewhat and thus resemble the rising hood of some of the older model automobiles. Moreover, additional transverse fold lines can be placed in the hood 8 so as to adjust and create different heights of the hood depending on the vehicle model. In lieu of transverse fold lines, a longitudinal fold line in hood 8 can cause the automobile to resemble even older model vehicles having a center longitudinal higher portion of the front hood. In such a case, a longitudinal hood fold can be folded gently to create an apex of the hood for such older model vehicles.

At the opposing end of the bottom segment is a second transverse fold 29 and adjacent thereto and extending outwardly therefrom is the trunk portion 35. Adjacent to the trunk portion 35 is the tail tab 37 extending therefrom and adjacent thereto, defined by third transverse fold 39. An optional transverse fold 31 defines the trunk shape still further to allow for a defined curvature.

The top portion 82 is situated between the side portions 83 and 49 and defined thereby by longitudinal folds 51 and 85. The rear under panel 81 provides some support for the trunk 35 as it is folded over. The top portion has an opening 84 defined by four sides 75, 76, 77, 79. However, this opening can be extremely small in the case of a coin bank, where the opening allows a coin to slip through. The interior is such that the tail tab 37, when the trunk 35 is folded over the rear panel 81, fits in and adjacent to the ends 92 and 94 at either end of interior edge 79. The realistic appearing steering wheel and dashboard assembly 71, is defined by a fold 75 and steering wheel cut 73 so as to allow the dashboard to fold down interior to the model and allow to be displayed thereon a detailed dashboard assembly and steering wheel. Nearly adjacent to the steering wheel at the desired location for the windshield is a tab receiving slot 69 (or receiving cut) for hood tab 10. This slot, in the preferred mode, has cuts on all sides, 96, 97, and 69, and a fold line at 95. The headlight hoods 53 and 55 and wheel well sections there behind, are formed by tabs 57 and 59 folding in at folds 61 and 63, respectively, allowed by cuts 65 and 67. These latter combinations allow for a realistic appearing headlight section with headlight hoods and wheel well sections commonplace to many older vehicles, particularly in the late to mid 1940's and 1950's.

Thus it can be seen that the model can be made by folding together the handful of folds very quickly, inserting the tabs, and in a very short time, a vehicle replica with an interior portion for holding food or other items is created. With an attractive print of an older vehicle thereon, a unique inexpensive device is created for promotional or other purposes.

It can also be seen that by pre-gluing or connecting the unit together at connecting tab 28, the unit can still be flattened easily but folded into an upright position almost instantly to expeditiously facilitate the on the spot creation of the model.

Figure 3:
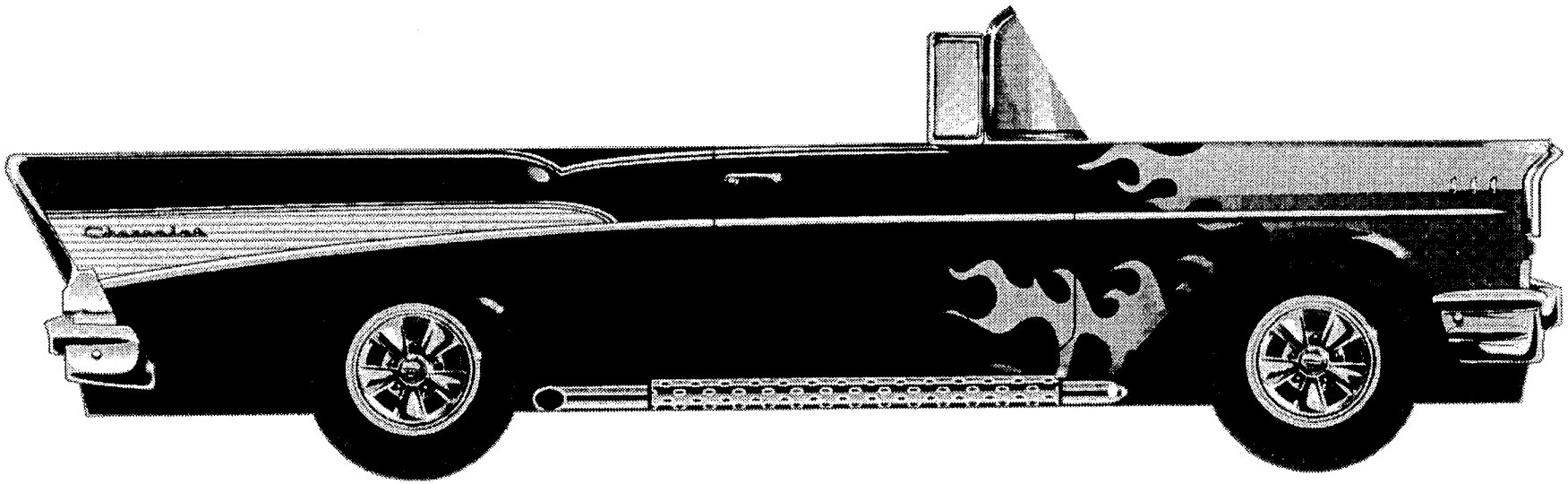
FIG. 3 is a side view of the assembled model based on the invention in FIG. 2.

FIG. 2 shows the invention drawn as a 1950's vintage CHEVROLET™, with the resulting side view shown in FIG. 3. It can be seen that upon assembling the invention to a completed model stage, realistic features and other objects of the invention are shown.

While there have been shown and described particular embodiments of the invention, it will be obvious to those skilled in the art that changes and modifications may be made without departing from the invention or its equivalent, and, therefore, it is intended by the appended claims to cover all such changes and modifications as fall within the true spirit and scope of the invention.

What is claimed is:

1. A cardboard model vehicle formed from a planer cardboard like sheet having four longitudinal segments and having various longitudinal fold lines and cuts, transverse fold lines and cuts and tabs, such that when folded along said fold lines and when tabs are inserted appropriately a vehicle replica is formed having an interior capable of holding contents therein, said model comprised of:

a. A planer cardboard-like sheet having substantially parallel longitudinal fold lines between and defining at least four segments including two side segments, a bottom segment having a front end and opposite thereto a rear end, and a top segment having a front end, rear end, and an interior opening therein;

b. A front hood segment extending longitudinally from a first transverse fold line at the bottom front end, said front hood segment having connecting tab means so as to connect the front hood segment with the front end of the top segment when the front hood segment is folded at the first transverse fold;

c. A trunk segment extending from the bottom rear end separated from a rear transverse fold at the bottom rear end, and having connecting tab means so as to connect the trunk segment with the rear end of the top segment when the trunk portion is folded at the rear transverse fold.

2. The cardboard model vehicle in claim 1 having two opposing longitudinal folding headlight defining tabs defined by longitudinal fold lines in the front end of the top segment such that when the tabs are folded, individually front headlights and wheel wells are created.

3. The cardboard model vehicle in claim 1 having two opposing folding headlight defining tabs defined by longitudinal fold lines in the front end of the top segment such that when the tabs are folded, front headlights and wheel wells are created, and wherein the front hood segment has a windshield assembly segment extending therefrom defined by a transverse fold line between the front hood segment and the windshield assembly.

4. The cardboard model vehicle in claim 1 having two opposing longitudinal folding headlight defining tabs defined by longitudinal fold lines in the front end of the top segment, such that when the tabs are folded, front headlights and wheel wells are created, and wherein the front hood segment has a windshield assembly segment extending therefrom defined by a transverse fold line between the front hood segment and the windshield assembly and having an inward folding dashboard-steering wheel segment extending from the front end of the top segment into the interior opening, and having a transverse fold line between said dashboard segment and top segment.

5. The cardboard model vehicle in claim 4 wherein the windshield assembly segment has windshield wing segments extending therefrom at opposite transverse ends of the windshield assembly, defined by fold lines separating said windshield wing segments from the windshield wing assembly.

6. The cardboard model vehicle in claim 1 wherein the front hood segment has a windshield assembly segment extending therefrom defined by a transverse fold line between the front hood segment and the windshield assembly.

7. The cardboard model vehicle in claim 6, and having an inward folding dashboard-steering wheel segment extending from the front end of the top segment into the interior opening, and having a transverse fold line between said dashboard segment and top segment.

8. The cardboard model vehicle in claim 7 wherein the windshield assembly segment has windshield wing segments extending therefrom at opposite transverse ends of the windshield assembly, defined by fold lines separating said windshield wing segments from the windshield wing assembly.

9. The cardboard model vehicle in claim 1 having an inward folding dashboard-steering wheel segment extending from the front end of the top segment into the interior opening, and having a transverse fold line between said dashboard segment and top segment.

10. The cardboard model vehicle in claim 9 having two opposing longitudinal folding headlight defining tabs defined by longitudinal fold lines in the front end of the top segment such that when the tabs are folded, front headlights and wheel wells are created, and having an inward folding dashboard-steering wheel segment extending from the front end of the top segment into the interior opening, and having a transverse fold line between said dashboard segment and top segment.

11. The cardboard model vehicle in claim 3 wherein the windshield assembly segment has windshield wing segments extending therefrom at opposite transverse ends of the windshield assembly, defined by fold lines separating said windshield wing segments from the windshield wing assembly.

12. The cardboard model vehicle in claim 6 wherein the windshield assembly segment has windshield wing segments extending therefrom at opposite transverse ends of the windshield assembly, defined by fold lines separating said windshield wing segments from the windshield wing assembly.

* * * * *